US007674042B2

(12) United States Patent
Von Blücher

(10) Patent No.: US 7,674,042 B2
(45) Date of Patent: Mar. 9, 2010

(54) DRINK RECEPTACLE, IN PARTICULAR DRINKING BAG, COMPOSED OF FLEXIBLE COMPOSITE MATERIAL

(75) Inventor: Hasso Von Blücher, Erkrath (DE)

(73) Assignee: Blucher GmbH, Erkrath (DE)

( * ) Notice: Subject to any disclaimer, the term of this patent is extended or adjusted under 35 U.S.C. 154(b) by 795 days.

(21) Appl. No.: 11/387,552

(22) Filed: Mar. 23, 2006

(65) Prior Publication Data

US 2006/0213913 A1 Sep. 28, 2006

(30) Foreign Application Priority Data

Mar. 24, 2005 (DE) ..... 10 2005 014 381
Apr. 14, 2005 (DE) ..... 10 2005 017 122

(51) Int. Cl.
*B65D 33/08* (2006.01)
*B65D 30/04* (2006.01)

(52) U.S. Cl. ..... 383/113; 383/116; 383/117

(58) Field of Classification Search ..... 220/495.03, 220/62.12, 709, 703, 705; 383/113, 80, 66, 383/116, 117, 41; 224/148.2
See application file for complete search history.

(56) References Cited

U.S. PATENT DOCUMENTS 4,505,310 A * 3/1985 Schneider ..... 141/114
4,606,951 A * 8/1986 Wakasugi et al. ..... 428/34.3
4,712,594 A * 12/1987 Schneider ..... 141/114
4,792,480 A 12/1988 Freund et al. ..... 428/286
4,795,665 A * 1/1989 Lancaster et al. ..... 428/34.2
5,115,947 A * 5/1992 McDonnell et al. ..... 222/107
5,403,123 A * 4/1995 Walters ..... 405/186
5,591,144 A * 1/1997 Smith et al. ..... 604/327
5,846,620 A * 12/1998 Compton ..... 428/35.7
6,164,822 A * 12/2000 Beer ..... 383/80
6,854,888 B1 * 2/2005 Brown et al. ..... 383/80
7,291,370 B2 * 11/2007 Gipson et al. ..... 428/36.1

(Continued)

FOREIGN PATENT DOCUMENTS

DE 38 29 501 A1 3/1989

(Continued)

OTHER PUBLICATIONS

*Römpp Chemielexikon*, 10$^{th}$ Edition, vol. 3, 1997, Georg Thieme Verlag, Stuttgart/New York, p. 2088, "Kaschieren".

(Continued)

*Primary Examiner*—Jes F Pascua
(74) *Attorney, Agent, or Firm*—Woodard, Emhardt, Moriarty, McNett & Henry LLP

(57) ABSTRACT

The invention relates to a drink receptacle (1), especially in the form of a drinking bag, having a wall (2) composed of a flexible composite material (3), the composite material (3) being water-impervious and gas-impervious and being at least essentially impervious to chemical and biological toxins, in particular warfare agents, or at least retarding their passage, and comprising an outer backing layer (4) and a film-like inner layer (5), wherein the backing layer (4) is textile-like and the inner layer (5) is laminated onto the backing layer (4), in particular at least essentially coextensively. The drink receptacle (1) of the invention combines good NBC protective or resistance properties with high mechanical stability, in particular puncture resistance, and also with a greater ease of manufacture.

19 Claims, 3 Drawing Sheets

U.S. PATENT DOCUMENTS

| | | | | |
|---|---|---|---|---|
| 2002/0179646 | A1 | 12/2002 | Petit | 222/173 |
| 2002/0179647 | A1 * | 12/2002 | Hall et al. | 222/175 |
| 2003/0168470 | A1 * | 9/2003 | Choi et al. | 222/14 |
| 2004/0007553 | A1 | 1/2004 | Smolko et al. | 215/12.1 |
| 2005/0236428 | A1 | 10/2005 | Quigley et al. | 222/107 |
| 2006/0174418 | A1 * | 8/2006 | Keller et al. | 8/115.51 |

FOREIGN PATENT DOCUMENTS

| | | | |
|---|---|---|---|
| FR | 947976 | | 7/1949 |
| JP | S57-188649 | Y | 11/1982 |
| WO | WO 2004/049846 | A2 | 6/2004 |
| WO | WO 2005/011437 | A1 | 2/2005 |

OTHER PUBLICATIONS

"Nylon" from http://en.wikipedia.org/wiki/Nylon, 8 pgs.

* cited by examiner

DRINK RECEPTACLE, IN PARTICULAR DRINKING BAG, COMPOSED OF FLEXIBLE COMPOSITE MATERIAL

CROSS-REFERENCES TO RELATED APPLICATIONS

This application claims priority to German Patent Application No. DE 10 2005 014 381.4, filed Mar. 24, 2005, and also claims priority to German Patent Application No. DE 10 2005 017 122.2, filed Apr. 14, 2005, entitled "DRINK RECEPTACLE, IN PARTICULAR DRINKING BAG, COMPOSED OF FLEXIBLE COMPOSITE MATERIAL". Both references are expressly incorporated by reference herein, in their entirety.

BACKGROUND OF THE INVENTION

The present invention relates to a drink receptacle, especially in the form of a drinking bag.

There are a whole series of entities which, on contact with the human body or on absorption by the human body, lead to serious physical harm. Examples include chemical warfare agents, for example the vesicatory mustard gas (Yellow Cross) and the nerve agent sarin. People likely to come into contact or take in such poisons have to be effectively protected against such poisons through suitable protective measures.

Biological warfare agents similarly represent an enormous potential hazard to people likely to come into contact with or take in such substances.

There are appropriate protective suits to protect the body, in particular the extremities and trunk. The head and in particular the face and also the respiratory tract are generally protected by wearing respirators with or without hoods. In addition, there are specific protective gloves that provide a protective function with regard to chemical and biological warfare agents, to protect the hands.

As well as protecting the body surface and the respiratory tract, it is similarly necessary to avoid any contamination through a possible uptake of chemical and biological warfare agents in the human body, as for example through the uptake of contaminated foodstuffs. This is because, in military deployment, people and soldiers have to be supplied with food, in particular with liquid, even in environments contaminated with chemical and biological toxins, for example battle areas, since the high level of physical exertion requires an increased intake of liquid in military deployments in particular. Regarding this, it must be ensured that the supply with liquid, for example with water or other beverages, is effected without endangering the person to be supplied; that is, the intake of poisons in the human body through infected or contaminated liquids is prevented. Since participants in military deployments for example cannot always simply be withdrawn from the territory which may be contaminated with chemical and biological toxins, it must be ensured that the foodstuffs to be transported into the territory, in particular liquids, such as beverages, are not contaminated to thereby safeguard the supply of liquid. In addition, a safe and secure intake of liquid has to be ensured during deployment in the field as well.

It is prior art to use drink receptacles for military or nuclear, biological and chemical (NBC) deployment that are said to provide a certain degree of protection against chemical and biological toxins.

WO 2005/011437 A1 relates to a portable drinking fluid carrier in two or more parts which comprises a flexible fluid container entirely encased within an NBC-protective cover produced from a chemically hardened material. The method of making such a two-part drink receptacle is relatively costly and inconvenient, and handling is not ideal in practice, since it is absolutely necessary that the inner fluid container be accommodated in the separate NBC-protective housing. This is disadvantageous in military deployment in particular, since fast and simple handling is required there and any degree of protection afforded according to WO 2005/011437 A1 does not become effective until the fluid container has been inserted into the housing.

US 2002/0179647 A1 relates to a hydration system for aircrew personnel in military deployment, the hydration system comprising a bladder configured to hold a fluid, the bladder comprising an outer layer of a fluorinated rubber composite. The inner layer of the bladder consists of a thermoplastic polymer. This hydration system has by virtue of the laminated plastics construction of the bladder little mechanical stability, in particular with regard to point penetration resistance puncture. This is because the absence of a stabilizing construction means that the bladder has only little resistance to point loads, in particular to puncturing by pointed or sharp articles. The hydration system is optimized for use in aircraft in that it only needs to be optimized against large area-based loads as might arise in the event of decompression in particular. For use in the field, in particular in a battle area, however, this system is unsuitable, since it precisely does not have good mechanical stability, in particular not a high point penetration resistance puncture as is required to counter pointed or sharp articles, corners, edges, etc. for example.

The present invention accordingly has for its object to provide a drink receptacle, in particular in the form of a drinking bag, having a protective function with regard to chemical and biological toxins which is suitable for military deployment or NBC deployment in particular and at least partially avoids, or at least ameliorates, the above-described disadvantages of the prior art.

The present invention further has for its object to provide a drink receptacle, in particular in the form of a drinking bag, having a protective function with regard to chemical and biological toxins, in particular NBC warfare agents, which is suitable for military deployment or NBC deployment and combines simplicity of manufacture and of construction with sufficient mechanical stability, especially a high puncture resistance (i.e. point penetration puncture resistance).

This object is achieved according to the present invention by a drink receptacle, especially in the form of a drinking bag, according to the disclosure. Further, advantageous embodiments of the drink receptacle of the present invention form the subject-matter of the dependent claims.

The present invention has for its fundamental idea that a drink receptacle having a wall composed of a flexible composite material which is water-impervious and gas-impervious and also at least essentially impervious to chemical and biological toxins, in particular warfare agents, or at least retards their passage and further comprising an outer backing layer and a film-like (foil-like) inner layer be endowed with an enhanced or improved protective performance with regard to chemical and biological toxins and with an improved mechanical stability by the backing layer being made textile-like and the inner layer being laminated onto the backing layer at least essentially coextensively. The term "coextensive" with respect to the lamination designates a continuous all-over lamination, i.e. a lamination over the whole surface of the two material pieces.

The specific construction of the composite material, featuring a textile backing layer and an inner layer laminated onto it, ensures that any chemical and biological toxins, for example chemical warfare agents or NBC warfare agents, which have succeeded in passing through the outer backing layer are effectively prevented by the blocking function of the inner layer from penetrating into the interior of the drink receptacle of the present invention. In other words, the drinking bag of the present invention possesses a high barrier effect with regard to chemical and biological toxins. In addition, the textile-like backing layer of the composite material endows the drink receptacle of the present invention with remarkable stability—especially with regard to improved point penetration/puncture resistance—so that the drink receptacle of the present invention is particularly suitable for use in a military territory or battle area.

More particularly, the drink receptacle of the present invention combines good NBC protective properties with high mechanical stability, especially point penetration/puncture resistance, and also with a greater ease of manufacture.

For the purposes of the present invention, the term "inner" identifies that region of the drink receptacle, of a wall of the drink receptacle or of a composite material of the drink receptacle that faces the drink receptacle's interior which is intended to accommodate a liquid. In other words, it refers to that region which, in the filled state, faces or is in contact with the liquid accommodated in the drink receptacle.

Furthermore, for the purposes of the present invention, the term "outer" identifies that region of the drink receptacle, of the wall of the drink receptacle or of the composite material of the drink receptacle that is disposed on the outer surface of the drink receptacle. It thus refers to that region which is in direct contact with an ambient atmosphere and not in contact with the liquid accommodated in the drink receptacle.

The term "equiareal" (as e.g. in an equiareal piece of fabric for example) refers in the context of the present invention to an at least essentially identical area size, although slight differences with regard to shape and/or size can be possible. The term "congruent" (as e.g. in congruent pieces of fabric for example) is to be understood as meaning that there is an essentially identical area size and/or an at least essentially identical shape.

"Food-compatible" (as e.g. in food-compatible inner layer for example) is to be understood in the context of the present invention as meaning in particular that a material used is at least essentially inert towards any food with which it is in contact. In other words, the materials of the constituents of the drink receptacle which are in contact with the liquid are to be chosen in the context of the present invention such that, first, the liquid is protected for example against evaporation with or without loss of aroma and, secondly, the emission of noxious entities into the accommodated liquid from the material used is avoided. For example, no dyes, plasticizers or the like should be released in particular.

Finally, "laminating" shall for the purposes of the present invention be understood as meaning the bonding together of two or more plies of identical or different materials (specifically for example the bonding together of the inner layer and of the backing layer) with or without use of suitable laminating agents. Laminating agents useful for the purposes of the present invention include for example adhesives suitable for laminating, such as hotmelts, waxes, polyethylene compounds, reactive plastics and certain natural or synthetic latex products. Laminating may be effected for example by the materials which are to be laminated together being conjoined under a contact pressure as may be exerted for example by rollers, rolls, calanders, and the like. A laminating agent may perhaps be superfluous in the case of thermotacky materials. For further observations in this regard, see *Römpp Chemiel-exikon*, 10$^{th}$ Edition, Volume 3, 1997, Georg Thieme Verlag, Stuttgart/New York, Page 2088, Headword: "Kaschieren" [Lamination], and also the literature cited there.

Further advantages, properties, aspects and features of the present invention will become apparent from the following description of preferred operative examples depicted in the drawings.

BRIEF SUMMARY OF THE INVENTION

The invention relates to a drink receptacle, especially in the form of a drinking bag, having a wall composed of a flexible composite material, the composite material being water-impervious and gas-impervious and being at least essentially impervious to chemical and biological toxins, in particular warfare agents, or at least retarding their passage, and comprising an outer backing layer and a film-like inner layer, wherein the backing layer is textile-like and the inner layer is laminated onto the backing layer, in particular at least essentially coextensively. The drink receptacle of the invention combines good NBC protective or resistance properties with high mechanical stability, in particular puncture resistance, and also with a greater ease of manufacture.

One object of the present invention is to provide an improved drink receptacle.

Related objects and advantages of the present invention will be apparent from the following description.

DETAILED DESCRIPTION OF THE INVENTION

Figure 1:
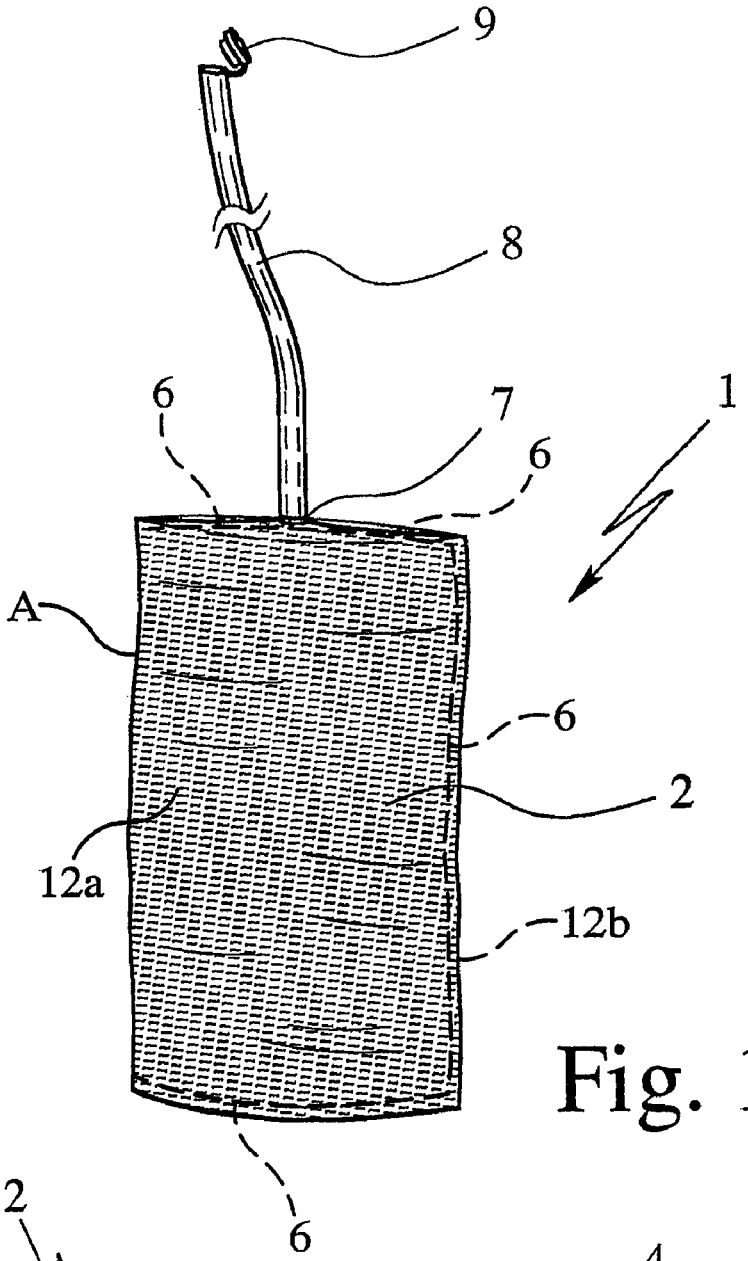
FIG. 1 is a schematic view of a drink receptacle in the form of a drinking bag in accordance with a preferred operative example of the invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Like reference signs refer in the figures to like parts, and corresponding properties and advantages are achieved even though repeated description is omitted for simplicity.

FIG. 1 shows a drink receptacle 1 in accordance with the present invention, in particular in the form of a drinking bag, having a wall 2. The wall 2 of the drink receptacle 1 consists of a flexible composite material 3, as depicted in section in FIG. 2. The composite material 3 is water-impervious and gas-impervious and it is at least essentially impervious to chemical and biological toxins, in particular warfare agents, or at least is configured such that it at least retards their passage.

Figure 2:
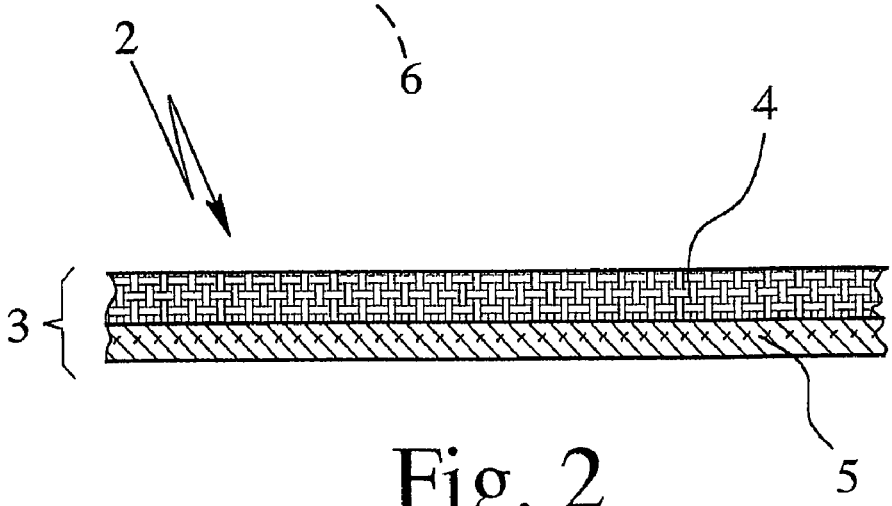
FIG. 2 is a schematic cut through a composite material of the drink receptacle.

As FIG. 2 further illustrates, the composite material 3 has an outer backing layer 4 and a foil-like (i.e. film-like) inner layer 5. In accordance with the present invention, the outer backing layer 4 is textile-like. Further in accordance with the present invention, the inner layer 5 is laminated onto the backing layer 4. Generally, the lamination is performed at least essentially coextensively, as shown in FIG. 2. This means that the inner layer 5 is laminated onto the backing area 4 at least essentially coextensively (i.e. as a continuous, all-over lamination over the whole surface of the two material pieces).

The coextensive or all-over laminating of backing layer 4 and inner layer 5 is generally effected in a conventional manner, in particular using suitable laminating agents, as previously described (i.e. generally adhesives). But it is similarly possible in accordance with the present invention to omit a laminating agent when the inner layer is thermotacky.

Owing to the use of the aforementioned composite material 3, which has a textile-like backing layer 4 and an inner layer 5, the drink receptacle 1 produced therefrom affords particularly high protection against chemical and biological toxins. The specific combination of textile backing layer 4 and inner layer 5 similarly confers on the drink receptacle 1 of the present invention a particularly high mechanical stability, especially with regard to its stability to point or point-shaped loads and thus its point penetration/puncture resistance. In other words, the drink receptacle 1 of the present invention combines the advantages of high protection against chemical and biological toxins on the one hand with high mechanical stability on the other, so that the drink receptacle 1 of the present invention is supremely useful for military deployment, in particular to supply soldiers with fluid,—and all that with distinctly simplified construction and manufacture compared with the prior art.

Figure 3A:
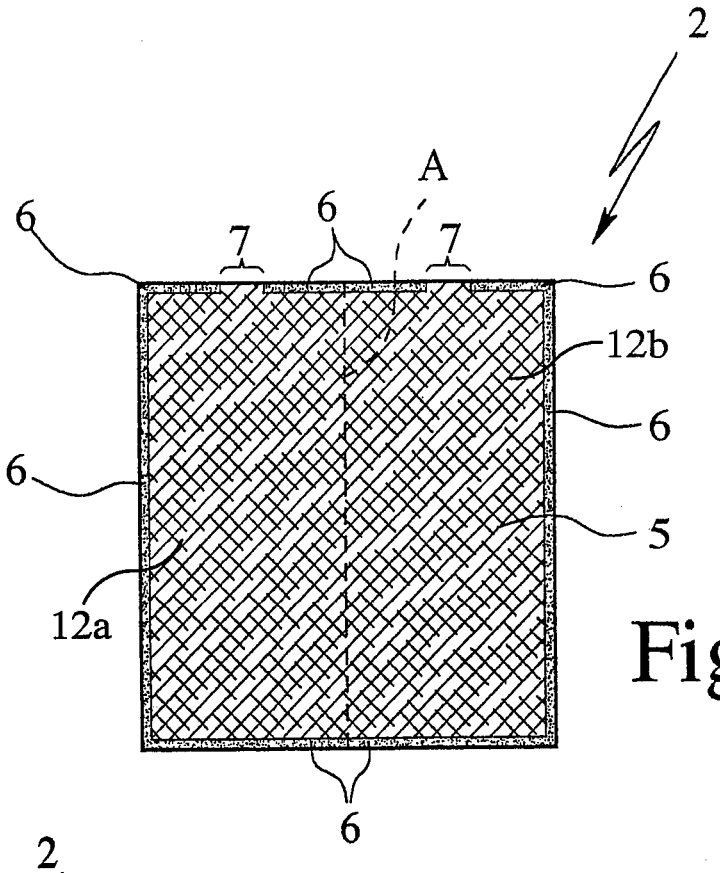
FIG. 3A is a schematic plan view of the inner surface of a one-piece wall or of a one-piece composite material of the drink receptacle.
Figure 3B:
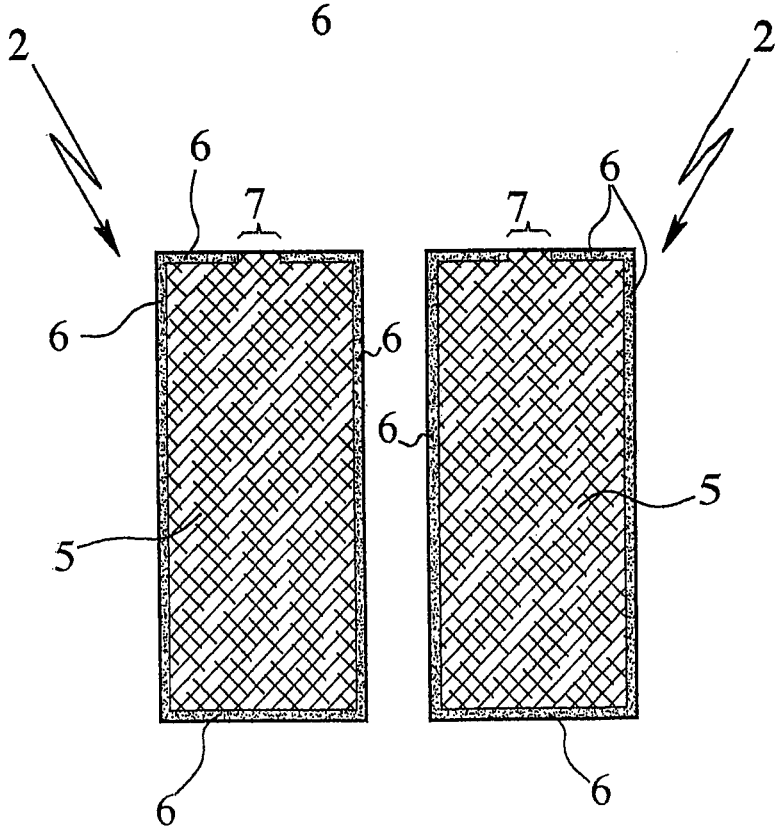
FIG. 3B is a schematic plan view of the inner surface of a two-piece wall or of a two-piece composite material of the drink receptacle in accordance with an alternative embodiment.

FIGS. 3A and 3B illustrate the simple construction of the drink receptacle 1 of the present invention. For instance, the drink receptacle 1 can be produced from a single sheet-like piece of the composite material 3, as shown in FIG. 3A. In accordance with an alternative embodiment, it is similarly possible to produce the drink receptacle 1 from a plurality, preferably two, substantially identical sheet-like pieces of the composite material 3, as shown in FIG. 3B.

FIG. 3A further illustrates the execution of the one-piece sheet-like piece of the composite material 3. The one-piece sheet-like piece of the composite material 3 is at least essentially symmetrical, in particular mirror symmetrical to an axis A along the sheet-like piece. In this way the left-side half 12*a* is essentially identical to the right-side half 12*b*. Thus, when folded along axis A, the peripheral edges of the left-side half align up with the peripheral edges of the right-side half, see FIG. 1.

With regard to the FIG. 3B two-piece execution which is preferred according to the present invention, the respective sheet-like pieces may be equiareal and preferably congruent. This significantly simplifies manufacture, since only one blank shape has to be used to manufacture the drink receptacle 1. In general, the sheet-like blanks have an at least essentially rectangular shape. But similarly other shapes are realizable as well—examples being arcuate edging trajectories or the like. It is still to be understood that the two pieces are essentially identical.

As further shown in FIGS. 3A and 3B, the sheet-like piece or pieces of the composite material 3 has or have peripheral bonding areas 6 which are preferably formed on or applied to the inner layer 5. With the exception of orifice 7, the bonding areas 6 frame the remainder of the inner layer 5. The bonding areas 6 are located adjacent the outer peripheral edge of each piece of material 3. The sheet-like piece or pieces of the composite material 3 are bonded together on the inner surface with regard to the drink receptacle 1 by joining the corresponding bonding areas together. The bonding of the sheet-like pieces of the composite material 3 is such that the sheet-like pieces are closely bonded together, preferably by the respective bonding areas 6 of one inner layer 5 being superposed on the bonding areas of the other inner layer 5.

In accordance with the embodiment depicted in FIG. 3A, utilizing a single sheet-like piece of the composite material 3, the drink receptacle 1 obtained is at least essentially in one piece. The herefore utilized sheet-like piece of the composite material 3 is preferably folded along one axis A such that the inner surfaces of the fold sections —the respective inner layer 5, that is—are superposed and the respective bonding areas 6 of the composite material 3 of one piece are aligned with the bonding areas 6 of the other piece and are bonded together, in particular by welding or adhering. This is done analogously with the two-piece embodiment of FIG. 3B.

The bonding of the composite material 3 and especially of the bonding areas 6 of the inner layer or layers 5 may be effected in a conventional manner. Welding is an option for example when the composite material 3, in particular the inner layer 5, is weldable, for example thermoplastic or thermoplastically weldable. The bonding areas 6 may also be adhered together using suitable adhesives, as described hereinbelow.

The adhering of the bonding areas 6 may utilize for example thermoplastic adhesives, in particular hotmelt adhesives, preferably polyurethanes, polyamides, polyesters or reactive hotmelts, or moisture- and/or radiation-curing hotmelts. It is preferable to use solvent-free and food-compatible adhesives. The adhering or welding may be effected by means of heat input, radio frequency irradiation and ultrasound input.

In preferred accordance with the present invention, the adhering or welding of the bonding areas 6 is preferably effected along the edges of the sheet-like piece or pieces of the composite material 3, resulting in a higher volume for accommodating liquid with regard to the drink receptacle 1. The result is a bag-like configuration for the drink receptacle 1, as illustrated by FIG. 1.

The bonding areas 6—as previously described—are preferably formed by the edge regions of the inner layer 5, as discernible from FIGS. 3A and 3B.

It is possible according to the present invention for the bonding of the bonding areas 6 to be effected by means of a plurality of mutually reinforcing forms of bonding. The bond may additionally be reinforced with an edge band which preferably covers the bonding area 6 from the outside or the inside, and preferably is mounted on the side of the backing layer 4.

The drink receptacle 1 of the present invention has a drinking orifice 7, as discernible from FIG. 1. The drinking orifice 7 serves in particular to remove liquid from the drink receptacle 1. It may similarly be used for filling, if appropriate.

FIGS. 3A and 3B reveal that the drinking orifice 7 may be formed by appropriate interruptions in the bonding areas 6. It is possible in accordance with the present invention that—if a single sheet-like piece of the composite material 3 is used for producing the drink receptacle 1—for the drinking orifice 7, or the interruptions in the bonding areas 6 forming the drinking orifice 7, to be disposed on the edges of the sheet-like piece which are opposite the axis A. But it is additionally possible that, as depicted in FIG. 3A, the drinking orifice 7 be disposed at that edge which has a perpendicular trajectory with regard to the axis A.

It is similarly possible in accordance with the present invention for the drinking orifice 7 to be formed by an orifice in the composite material 3 to which the removal means 8 is connected or connectable. In this case, the bonding areas 6 are configured to be uninterrupted or continuous.

In accordance with a preferred embodiment of the present invention, the drink receptacle 1 has a further, second orifice (not depicted) which is preferably resealable and/or which serves to fill the drink receptacle 1. The second orifice may be closed by means of a closure, such as a stopper or lid. The second orifice makes it possible in accordance with the present invention to fill the drink receptacle 1 in a simple manner. The presence of a second orifice further enables better cleaning of the drink receptacle 1, an advantage with regard to the reusability of the drink receptacle 1.

As shown in FIG. 1, the drink receptacle 1 may also have removal means 8 for removing or letting liquid out of the drink receptacle 1. The removal means 8 is preferably connected or connectable via the drinking orifice 7. The transition between the drinking orifice 7 on the one hand and the removal means 8 on the other is sealed off in the aforementioned sense; that is, the transition may be welded, adhered or the like. In accordance with the present invention, the removal means 8 is preferably press fitted into the drinking orifice 7 and may additionally be sealed off with a sealant if appropriate.

As further shown in FIG. 1, the removal means 8 may be hose-like or tube-like. It is possible in accordance with the present invention for the removal means 8 to extend beyond the drinking orifice 7 in the direction of the inner space of the drink receptacle 1, so that liquid can be removed from the drink receptacle 1 even when the liquid fill level is low. It is similarly possible in accordance with the present invention for the removal means 8 to extend as far as the volume confinement opposite the drinking orifice 7, as far as the "bottom" of the drink receptacle 1 so to speak.

The removal means 8 may be for example a flexible hose or tube. The removal means 8 may consist of a plastic or of a polymer, in which case the removal means 8 should be similarly gas or air impervious, water impervious and impervious to chemical and biological toxins. It is particularly preferable for the removal means 8 to consist of butyl rubber, which may be halogenated if appropriate.

The removal means 8 may similarly connect once to the drink receptacle 1 or be replaceable, or like a disposal article be inserted once into the drinking orifice 7 and disposed of after use.

As shown in FIG. 1, the removal means 8 may be resealable, in which case in particular a lid 9, a flap, a valve or the like can be used. Further non-limiting examples of closure means useful according to the present invention are twist closures, hose clamps and the like.

The removal means 8 is advantageously embodied such that it is compatible with regard to respirators, more particularly it can be inserted into the receiving orifice provided in respirators and fixed therein, so that liquid uptake from the drink receptacle 1 is possible when a respirator is being worn.

In accordance with a particular embodiment, the removal means 8 may be flameproof, i.e. consist of or be endowed with a flameproof, especially heat- and/or fire-resistant material. In this particular embodiment, it is preferable for the drink receptacle to be flameproof as a whole or as such. This permits use under extreme conditions (for example when fire fighting or staying in fire areas).

The backing layer 4 of the composite material 3 may be configured as a textile sheet-like construction. More particularly, the backing layer 4 may be a fabric, such as e.g. a woven, knitted, no crimp or nonwoven fabric or a textile composite. More particularly, the backing layer 4 may be a textile sheet-like construction composed of polyester, polyamide, cotton and/or meta-aramid fibres. Textile sheet-like constructions composed of cotton fibres may utilize pure fibres of cotton or else blends with other fibres.

More particularly, the backing layer 4 has a basis weight (i.e. weight per unit area) in the range from 50 to 500 g/m$^2$, in particular in the range from 100 to 300 g/m$^2$ and preferably in the range from 140 to 280 g/m$^2$.

The thickness of the backing layer 4 may be in the range from 50 μm to 5 mm, in particular in the range from 100 μm to 3 mm, preferably in the range from 250 μm to 2 mm, more preferably in the range from 300 μm to 1 mm and even more preferably in the range from 400 μm to 0.5 mm.

To further resist penetration of chemical and biological poisons (for example of concentrated drops of warfare agents) and thus to augment the barrier function of the inner layer 5, it is advisable if appropriate to oleophobicize and/or hydrophobicize the material of the backing layer 4, especially through a specific impregnation or coating.

The inner layer 5 of the composite material 3 is preferably constructed as a film (i.e. a foil). Preferably, in accordance with the present invention, the inner layer 5 is a continuous, in particular uninterrupted, film or foil. Especially, the inner layer 5 is preferably constructed as a film or foil, especially as a plastic and/or polymer film or foil, or alternatively as a metal film or foil.

Furthermore, the inner layer 5 should be constructed such that it is at least essentially impervious to liquids, in particular water, and to aerosols. Furthermore, the inner layer 5 should preferably be constituted such that it is at least essentially water-vapour impervious or gas-impervious, especially air-impervious. Owing to these properties of the inner layer 5, the present invention ensures that the drink receptacle 1 according to the invention has good leakproofness with regard to the liquid to be accommodated, in particular since evaporation of the liquid from the drink receptacle 1 is at least essentially avoided. On the other hand, the inner layer 5 similarly prevents the ingress of chemical or biological toxins into the inner volume of the drink receptacle 1, so that the liquids contained therein are effectively protected against such substances.

In other words, the inner layer 5 is at least essentially impervious to chemical and biological toxins, in particular warfare agents, or at least retards their passage.

As regards the further properties of the inner layer 5, it may be thermoplastic for example. For example, the inner layer 5 may be thermotacky or weldable. This makes it possible to laminate the inner layer 5 onto the backing layer 4 in the previously described manner without any need for an additional adhesive. Owing to the thermoplastic or thermotacky or weldable properties of the inner layer 5, an efficient and durable sheet-like bond between the backing layer 4 and the inner layer 5 can be produced, which distinctly reduces the risk of delamination.

The inner layer 5 may have a thickness in the range from 1 μm to 2 mm, in particular in the range from 1 μm to 1 mm, preferably in the range from 5 μm to 0.5 mm and more preferably in the range from 5 μm to 100 μm.

The inner layer 5 may consist of or comprise for example a plastic or a polymer or polymer material. Such a plastic or such a polymer may be suitably selected for example from the group of polyurethanes, polyamides, polyetheramides, polyesters, polyesteramides, polytetrafluoroethylenes, polyvinylidene chloride (PVDC) and polyolefins, especially polyethylene and polypropylene, and also derivatives thereof. It is preferred in accordance with the present invention for the plastic and/or the polymer to be selected from polyamides and polyesters, more preferably polyesters.

In accordance with the present invention, the inner layer 5 is preferably a polyamide film or a polyester film, more preferably a polyester film.

In accordance with an embodiment of the present invention, the inner layer 5 may be configured as a membrane (i.e. a membrane-like film).

With regard to the plastic or polymer used for the inner layer 5, the plastic or polymer should be food compatible in the aforementioned sense for the purposes of the present invention.

In accordance with a further, alternative embodiment, the inner layer 5 may be or comprise a metal film (i.e. a metal foil), in which case such metal films are useful as are suitable for the food sector and are food compatible in the aforementioned sense. Suitable alloys can also be used in this regard.

Similarly, a combination of at least one metal film with at least one plastic or a polymer film is possible.

The overall thickness of the composite material 3, comprising the backing layer 4 and the inner layer 5, is generally in the range from 50 μm to 10 mm, in particular in the range from 50 μm to 5 mm, preferably in the range from 50 μm to 1 mm and more preferably in the range from 50 μm to 0.5 mm.

The specific construction of the drink receptacle 1 according to the invention or of the composite material 3 provides an excellent barrier effect against chemical and biological warfare agents. The barrier effect of the drink receptacle 1 or of the composite material 3 or of the inner layer 5 against chemical warfare agents, in particular bis-[2-chloroethyl]-sulphide (mustard gas, Hd, Yellow Cross), measured according to CRDEC-SP-84010, method 2.2, permits penetration of not more than 4 $\mu g/cm^2$ per 24 h, in particular not more than 3.5 $\mu g/cm^2$ per 24 h, preferably 3.0 $\mu g/cm^2$ per 24 h and more preferably not more than 2.5 $\mu g/cm^2$ per 24 h.

Owing to the specific construction in accordance with the present invention, the drink receptacle 1 of the present invention has the significant advantage of possessing high stability or strength as well as providing protection against chemical and biological warfare agents. The drink receptacle 1 of the present invention is capable of withstanding not just a high areal pressure, but also possesses a very high point penetration/puncture resistance, i.e. the drink receptacle 1 of the present invention is capable of withstanding even high small-area pressing loads, as may be exerted for example through forceful application of pointed articles.

Owing to the combination of these properties—barrier effect against chemical and biological toxins on the one hand and high mechanical strength on the other—in a single material, the drink receptacle 1 of the present invention is particularly suitable for military deployment, in particular for supplying soldiers with liquid in a battle area. The aforementioned properties of the drink receptacle 1 of the present invention are provided by the specific construction of the composite material 3. The inner layer 5 ensures the previously described high barrier effect against chemical and biological toxins, and this barrier effect is additionally augmented by the possibly oleophobicized or hydrophobicized backing layer 4. The high mechanical resistance is ensured by the backing layer 4 and additionally reinforced by the laminated inner film or foil, so that backing layer 4 and inner layer 5 form a functional unit.

Owing to its high flexibility, the drink receptacle 1 of the present invention is virtually unburstable, and its bag-like construction means that the drink receptacle 1 of the present invention can be stored, stacked or transported in a space-saving manner.

The present invention has the further advantage that the drink receptacle 1 of the present invention is reusable or recyclable, since it possesses good decontaminability. The presence of the inner layer 5 ensures that the drink receptacle 1 is decontaminable and regenerable; any poisons which have succeeded in passing through the backing layer 4 can be removed again from the inner layer 5 through appropriate methods of treatment (an example being rinsing down), for example with suitable decontaminating solutions, which one skilled in the art will be very familiar with for these purposes.

The drink receptacle 1 of the present invention may be fabricated in various sizes, so that it may be adapted to the planned deployment. The inner volume of the drink receptacle 1 of the present invention may be for example 100 ml to 5 litres or even more.

Figure 4A:
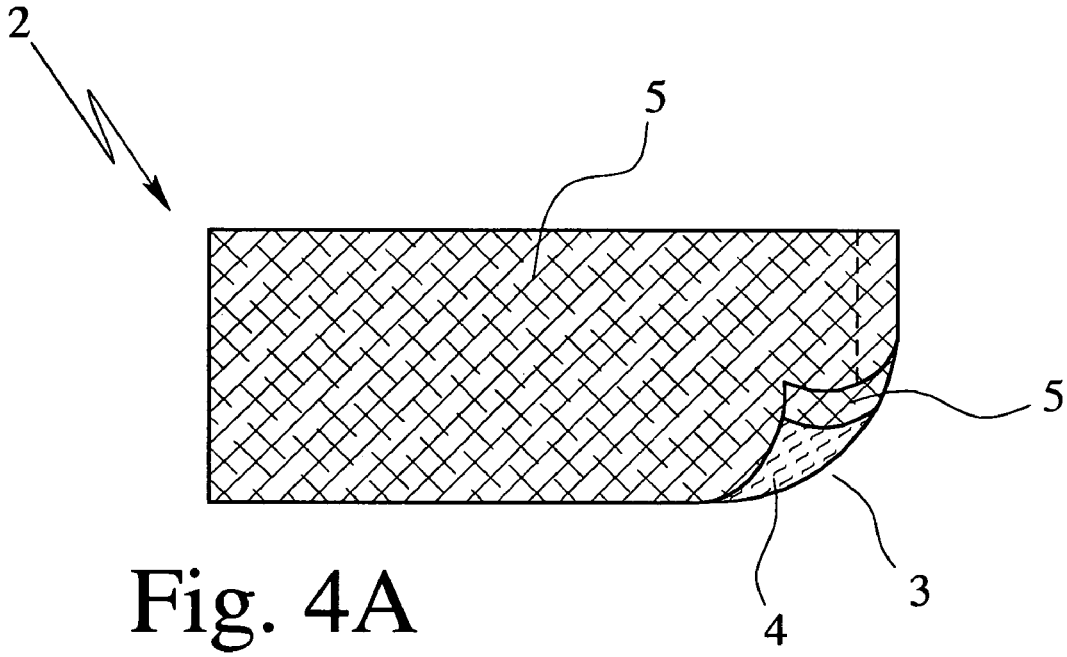
FIG. 4A is a schematic plan view of the inner surface of a wall for a drink receptacle in the form of a drinking beaker in accordance with an alternative embodiment.
Figure 4B:
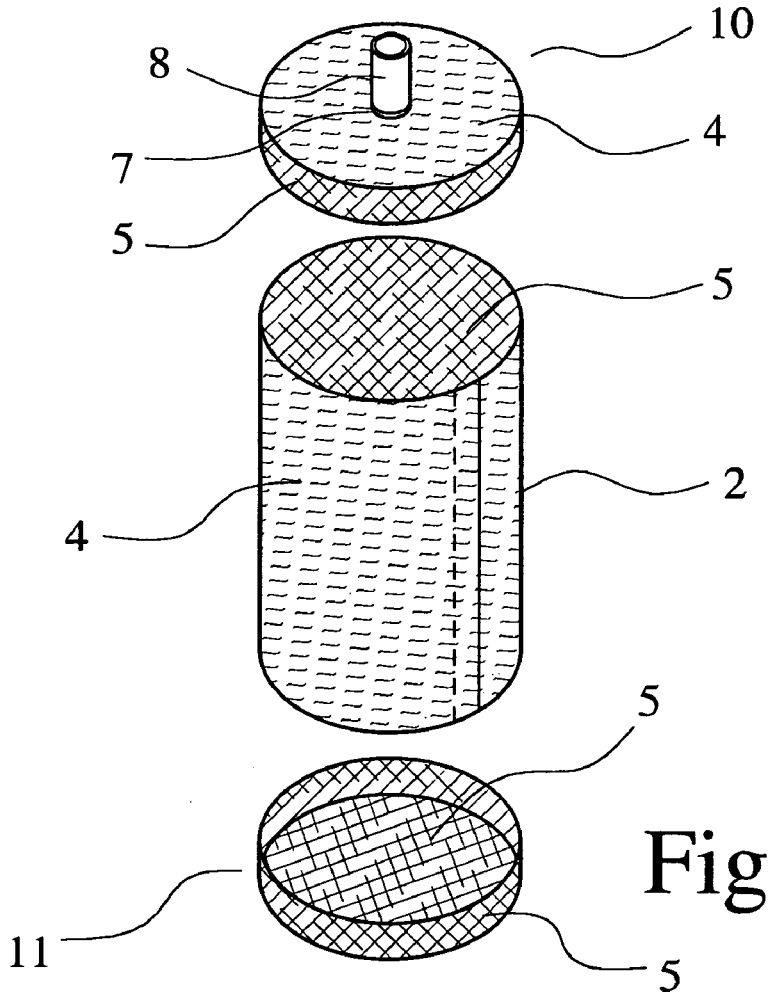
FIG. 4B is a schematic depiction of a drink receptacle in the form of a drinking beaker in accordance with an alternative embodiment.

In accordance with an alternative embodiment of the present invention, although less preferred according to the present invention, the drink receptacle 1 may also be configured in the form of a drinking beaker, as illustrated in FIGS. 4A and 4B. Appropriately greater thicknesses of the composite material 3 are used for this purpose. FIG. 4A shows that an at least essentially rectangular sheet-like piece of the composite material 3 is used to form—as shown in FIG. 4B—a preferably cylindrical wall 2 for the drinking beaker. The preferably cylindrical wall 2 of the drinking beaker is configured such that the backing layer 4 is on the outside and the inner layer 5 on the inside.

The preferably cylindrical wall 2 of the drinking beaker is particularly formed such that one end or edge region of the inner layer 5 is joined to the opposite end or edge region of the inner layer 5 of the composite material 3 in the aforementioned manner.

As further illustrated in FIG. 4B, the drinking beaker further has a beaker lid 10, which is preferably round or circular and forms the upper termination and preferably comprises a drinking orifice 7 or a removal means 8.

The drinking beaker further has a beaker bottom 11 which preferably has a comparable shape to the beaker lid 10. The beaker bottom 11 preferably forms the lower termination of the drinking beaker.

The beaker lid 10 and the beaker bottom 11 are preferably constructed such that the edge of the beaker lid 10 and of the beaker bottom 11 is formed by the inner layer 5 which is bonded, for example adhered or welded, in the previously described manner to the inner layer 5 of the cylindrical wall 2 of the drinking beaker.

The drinking beaker may similarly have a second orifice (not depicted), which preferably serves to fill the drinking beaker and may for example be resealable.

The drink receptacle 1 of the present invention can be produced in a conventional manner. An example of a possible procedure for producing a drink receptacle according to the present invention is as follows: The composite material 3 may be produced for example by laminating a membrane about 5 μm to 100 μm thick as an inner layer 5 onto a backing layer 4, the backing layer 4 serving to reinforce and stabilize the inner layer 5. Subsequently, the composite material 3 may be cut for example into two equiareal sheet-like pieces, and these are subsequently joined together such that the respective inner layers 5 are bonded together at bonding areas 6, especially by adhering or welding. The bonding area 6 may be interrupted to form a drinking orifice 7. Furthermore, the bonding area 6 may have a further interruption to form or accommodate a second orifice. The drinking orifice 7 may further be provided with a removal means 8 which is similarly bonded to the drinking orifice in the region thereof, for example endurably and for example by adhering or welding. The thus produced drink receptacle 1 of the present invention may subsequently be filled with a liquid, in particular a potable liquid, and subsequently be stored or transported.

The drink receptacle 1 of the present invention may be filled with suitable liquids ensuring proper hydration of people, examples being water, fruit juices, tea beverages, coffee, isotonic drinks or the like.

Further refinements, modifications and variations of the present invention will become apparent to and realizable by the ordinarily skilled on reading the description without their having to depart from the realm of the present invention.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A drink receptacle, especially in the form of a drinking bag, the drink receptacle having a wall composed of a flexible composite material, wherein the composite material is water-impervious, air impervious and substantially impervious to chemical and biological toxins, sufficient to retard their passage, and comprises an outer backing layer and a film-like inner layer, wherein the backing layer is textile-like, wherein the material of the backing layer is oleophobicized and/or hydrophobicized, wherein the inner layer is laminated onto the backing layer coextensively as a continuous all-over lamination and wherein the inner layer is constructed and arranged as a substantially continuous polymer film that is impervious to liquids and to chemical and biological toxins, wherein the drink receptacle has a drinking orifice for removing liquid from the drink receptacle, wherein a resealable conduit removal means for removing liquid from said drink receptacle is connected or connectable to the drink receptacle, and wherein the conduit removal means is press-fitted into the drinking orifice and is additionally sealed off wherein the composite material and the drink receptacle as a whole have a barrier effect against chemical warfare agents, measured according to Method 2.2 of CRDEC-SP-84010, of not more than 4 $\mu g/cm^2$ per 24 h.

2. The drink receptacle according to claim 1, wherein the drink receptacle is produced from two substantially identical sheet-like pieces of the composite material.

3. The drink receptacle according to claim 2, wherein the sheet-like pieces of the composite material are joined together along aligned bonding areas.

4. The drink receptacle according to claim 2, wherein each sheet-like piece includes bonding areas framing a continuous, uninterrupted film of plastic.

5. The drink receptacle according to claim 2, wherein each sheet-like piece includes bonding areas framing a continuous, uninterrupted layer of metal foil.

6. The drinking receptacle according to claim 1, wherein the drinking receptacle has a bag-like construction.

7. The drink receptacle according to claim 1, wherein the backing layer is a textile sheet-like construction or a flat-shaped textile material.

8. The drink receptacle according to claim 1, wherein the backing layer has a basis weight in the range from 50 to 500 $g/m^2$.

9. The drink receptacle according to claim 1, wherein the backing layer has a thickness in the range from 50 μm to 5 mm.

10. The drink receptacle according to claim 1, wherein the oleophobicized and/or hydrophobicized condition of the material of the backing layer results from a specific impregnation process.

11. The drink receptacle according to claim 1, wherein the inner layer is impervious to liquids, aerosols and gases and impervious to chemical and biological toxins.

12. The drink receptacle according to claim 1, wherein the inner layer is thermoplastic and thermotacky or weldable.

13. The drink receptacle according to claim 1, wherein the thickness of the inner layer is in the range from 1 μm to 2 mm.

14. The drink receptacle according to claim 1, wherein the inner layer comprises or consists of a plastic or a polymer, wherein the plastic or the polymer is selected from the group consisting of polyurethanes, polyamides, polyether-amides, polyesters, polyesteramides, polytetrafluoroethylenes, polyvinylidene chloride (PVDC) and polyolefins and derivatives and mixtures thereof.

15. The drink receptacle according to claim 1, wherein the inner layer is a polyamide or polyester film.

16. The drink receptacle according to claim 1, wherein the overall thickness of the composite material is in the range from 50 μm to 10 mm.

17. The drink receptacle according to claim 1, wherein the drink receptacle is produced from a single sheet-like piece of the composite material including a fold line and two substantially identical halves.

18. The drink receptacle according to claim 17, wherein the halves of the single sheet-like piece each include corresponding bonding areas for joining the two halves together.

19. The drink receptacle according to claim 1, wherein the oleophobicized and/or hydrophobicized condition of the material of the backing layer results from a specific coating process.

* * * * *